United States Patent [19]

Schrewe et al.

[11] 4,094,707

[45] June 13, 1978

[54] MAKING WITHDRAWAL ROLLERS FOR INGOTS

[75] Inventors: Hans Schrewe, Duisburg; Klaus Frenken, Krefeld, both of Germany

[73] Assignee: Mannesmann Aktiengesellschaft, Dusseldorf, Germany

[21] Appl. No.: 822,918

[22] Filed: Aug. 8, 1977

[30] Foreign Application Priority Data

Aug. 9, 1976 Germany ..... 2636199

[51] Int. Cl.[2] ..... B21H 1/14

[52] U.S. Cl. ..... 148/12 R; 29/148.4 D; 148/127

[58] Field of Search ..... 148/127, 12 R; 29/148.4 D, 110, 129.5, 132

[56] References Cited

U.S. PATENT DOCUMENTS

| | | | |
|---|---|---|---|
| 3,089,409 | 5/1963 | Tretheway et al. | 29/132 |
| 3,138,338 | 6/1964 | McKenna | 29/132 |
| 3,416,435 | 12/1968 | Dahl et al. | 29/132 |
| 3,609,849 | 10/1971 | Krol | 29/132 |
| 3,842,471 | 10/1974 | Polhall et al. | 29/132 |
| 3,974,555 | 8/1976 | Strohmeier et al. | 29/132 |

*Primary Examiner*—W. Stallard

*Attorney, Agent, or Firm*—Ralf H. Siegemund

[57] ABSTRACT

A roller body is made of relatively low alloyed steel and sinter-coated for protection at a temperature up to 1000° C; the coating is mechanically surface finished and the assembly is normalized and tempered followed by air cooling to enhance toughness and tensile strength of the roller body.

7 Claims, 1 Drawing Figure

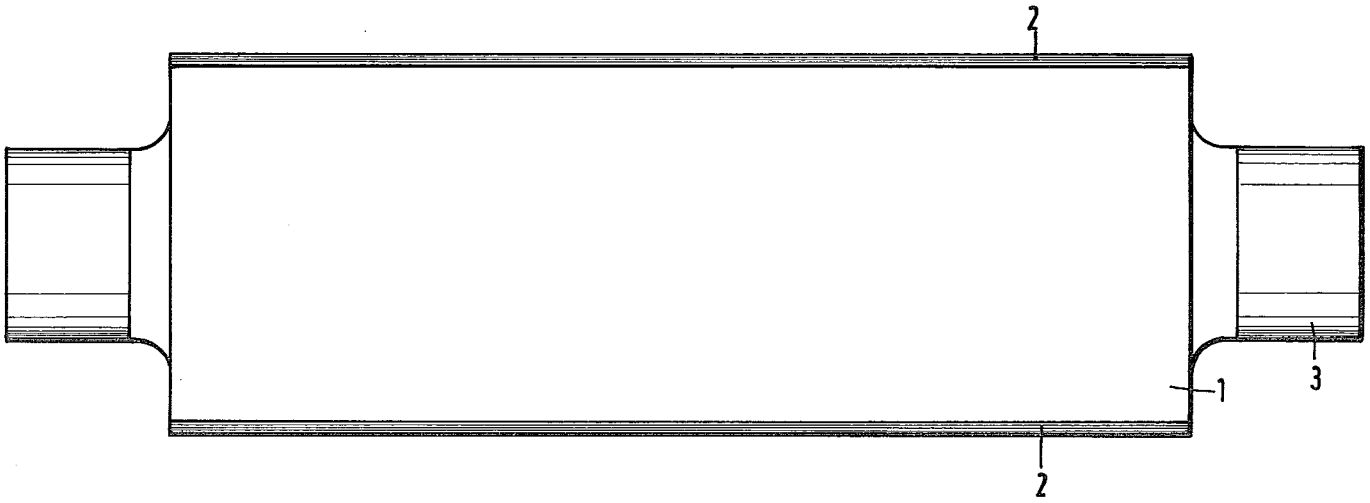
2
1
3
2

MAKING WITHDRAWAL ROLLERS FOR INGOTS

BACKGROUND OF THE INVENTION

The present invention relates to the making of rolls or rollers to be used as withdrawal and support rollers for ingots as emerging from a mold for continuously casting; and more particularly, the invention relates to the thermal treatment of such rollers during their completion.

Rollers of the type to which the invention refers are usually provided with a sprayed-on and sintered coating made, e.g. of a nickel-chronium-alloy. As the roller is coated, sintering of the coating requires heating to temperatures from 800° C to 1000° C, and it is inevitable that the roller body be heated, at least in parts, to that temperature. If the rollers have not been heat treated previously to obtain particular toughness and/or tensile strength, the heating during the sintering poses no problems. However, if the roller was particularly normalized and tempered, sintering may cause the roller to loose again the particular mechanical properties. Consequently, one has usually used for the construction of the roller bodies those kinds of materials which do not require such a thermal treatment, that is to say, one uses rollers made out of steel which has a high tensile strength even without strength and toughness enhencing thermal treatment. These are usually highly alloyed steels and very expensive.

Materials that require tempering to be strong at high temperatures are known, for example, under the DIN designation 17 Mn Mo V 64; or 10 Cr Mo 910; 13 Cr Mo 44; 15 Mo 3 or 35 Cr Mo 4. Rolls made of 17 Mn Mo V 64 steel are, for example, thermally treated as follows: The roller is normalized at 920° C for a duration of 2 hours, followed by cooling in the furnace. Next, the roller is tempered at 620° C to 680° C for 3 hours, followed by cooling in air. Now, if the roller is spray coated and sintered at 800° C to 1000° C, the prior normalizing and tempering comes to naught. Moreover, the sinter process may lead to heat cracks in the interior of the roller.

DESCRIPTION OF THE INVENTION

It is an object of the present invention to overcome the deficiencies outlined above.

It is a particular object of the present invention to provide a new and improved method of making rollers, e.g., for use in ingot withdrawal roller tracks, which method permits employment of, e.g., a relatively low alloyed steel or the like but which can (and should) be thermally treated to obtain specific tensile properties, and particularly high toughness, without impeding these properties on account of sinter coating the roller.

In accordance with the preferred embodiment of the present invention, it is suggested to spray coat and sinter a protective coating onto a roller of strong but not yet tempered material (at least not for purposes of enhencing toughness and tensile strength), and to obtain the desired tensile strength and toughness through subsequent thermal treatment. The thermal treatment is to follow particularly the final, mechanical surface treatment and finishing of the rather thick (≧ 1 mm) protective sintered coating. This means that after the final thermal treatment step, only the axles of the roller are to be ground and polished.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE is a schematic section view taken through a roller treated and to be treated in accordance with the preferred embodiment of the invention, any cooling ducts in the interior of the roller have been omitted as they are not relevant for the invention.

The FIGURE shows in particular a roller body 1 with axle ends 3, and a protective, sintered coating 2, being not thinner than 1 mm. The roller is made in the following manner.

A cylindrical body is prepared at first in the usual manner, as far as machining is concerned. Next, a coating is placed onto (sprayed-on and sintered) the roller body 1, the coating having the following consistency: 15 to 20% Cr; 65 to 75% Ni; and not more than 5% each Si and B (all percentages by weight). The coating so made is about 1 mm thick. Sintering is carried out at 700° C to 1000° C. Following the completion of coating, the surface of the coating is fine finished, i.e. polished.

Next, the mechanically completed roller is normalized. If the roller body is made of 17 Mn Mo V 64 steel, one will normalize at 920° to 960° C for about 2 hours, followed by tempering at 620° C to 680° C for about 3 hours, followed, in turn, by cooling in air.

The normalizing and even the tempering temperatures will soften the sintered coating. Thus, the roller should stand upright, i. e., having its axis in a vertical position in the furnace. Additionally or alternatively, the roller should be continuously rotated during the thermal treatment to ensure uniform heating. The completed roller may still require that its axles 3 are ground an polished.

The resulting coated and strengthened roller has a considerably longer life than known coated rollers, and the new rollers are more economical than rollers made of highly alloyed steel.

The invention is not limited to the embodiments described above but all changes and modifications thereof not constituting departures from the spirit and scope of the invention are intended to be included.

We claim:

1. A method of making rollers for withdrawal of hot ingots, comprising the steps of:

making a roller body of high tensile material but requiring thermal treatment for enhancing toughness;

providing a relatively thick protective coating onto the roller, and sintering the coating;

mechanically surface finishing the coating; and thermally treating the roller body carrying the coating to enhance toughness and tensile strength of the roller.

2. Method as in claim 1, wherein the thermal treatment includes normalizing followed by tempering.

3. Method as in claim 1, wherein the coating is sprayed-on and sintered at a temperature in excess of temperatures of the thermal treatment.

4. Method as in claim 1, wherein a material is used for coating being comprised of 15 to 20% Cr, 65 to 75% Ni;

not more than 5% each Si and B, the sintering being carried out at a temperature in the range from 700° to 1000° C; the thermal treatment involving normalizing at 920° C to 960° C, and temperating at 620° C to 680° C.

5. Method as in claim 1, wherein the coating is made to be not thinner than 1 mm.

6. Method as in claim 1, wherein the roller is rotated during the thermal treatment.

7. Method as in claim 1, wherein the roller has a vertical position during the thermal treatment.

* * * * *